US007968782B2

(12) United States Patent
Mackie

(10) Patent No.: US 7,968,782 B2
(45) Date of Patent: Jun. 28, 2011

(54) ONE PIECE FLEXIBLE TETHERING-BAN FOR DRUMSTICKS

(76) Inventor: Kevin Mackie, Glasgow (GB)

( * ) Notice: Subject to any disclaimer, the term of this patent is extended or adjusted under 35 U.S.C. 154(b) by 0 days.

(21) Appl. No.: 12/481,413

(22) Filed: Jun. 9, 2009

(65) Prior Publication Data

US 2009/0308227 A1 Dec. 17, 2009

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 3,365,108 A * 1/1968 Giba ..... 224/217
7,375,271 B1 * 5/2008 Zelinsky ..... 84/422.4

* cited by examiner

*Primary Examiner* — Kimberly R Lockett
(74) *Attorney, Agent, or Firm* — Jeffery D. Frazier

(57) ABSTRACT

A flexible one-piece self-gripping self-forming-loop attachment, comprising a single ergonomically shaped and dimensioned strip of elastic material with circular apertures at opposing ends for attachment to a drumstick by inserting one end of the drumstick through each aperture in turn giving rise to a loop which is slid along the drumstick to the desired playing position at which a finger is inserted. When the loop is fitted the material surrounding the apertures stretches and causes their shape to change according to the profile of the drumstick.

19 Claims, 3 Drawing Sheets

ONE PIECE FLEXIBLE TETHERING-BAN FOR DRUMSTICKS

BACKGROUND OF THE INVENTION

1. Field of Invention

This invention relates generally to the control of a drumstick while playing and more particularly to preventing the loss of grip.

2. Description of the Prior Art

When a drummer is playing there can be a loss of grip of one or more drumsticks through tiredness, hand perspiration, poor technique, distraction, and fatigue. This may result in the stick being dropped or accidentally thrown which interrupts the performance and could result in injury.

It is an object of the invention to provide a means of preventing a drumstick slipping away from the drummer's preferred grip position.

Current means and methods to prevent loss of grip include using wrapping tape, tubular sleeves of various materials and assorted waxes and liquid substances which are applied to the drumstick. There are also products that apply to the hands such as specially-made gloves.

Wrapping tape wears quickly. Tubular sleeves increase the diameter of the drumstick and add weight. Waxes and liquid substances are inconvenient to use and in many cases need to be reapplied. Gloves are cumbersome and lead to increased hand perspiration.

Within patent literature there is reference to other devices.

BACKGROUND

For example U.S. Pat. No. 3,866,508 to Huislig, U.S. Pat. No. 4,476,768 to Willis and U.S. Pat. No. 4,719,836 to Baumgart are references relating to grip issues for drumsticks but these are all concerned with drumsticks modified in some manner to aid grip. U.S. Pat No. 7,375,271 to Zelinsky uses a multi piece device which comprises a loop attached to a drumstick using a bracket affixed by a screw thereby modifying the drumstick and affecting the integrity of the drumstick.

U.S. Pat No. 5,370,030 to Home teaches a drumstick modified for the purpose of holding specifically the index finger of the drummer in a fixed position for the purpose of providing a pivot for spinning the stick around the finger. U.S. Pat No. 7,435,889 to Heidt teaches a tool that enables the drummer to rapidly twirl the drumstick using a swivelling apparatus. These two patents make reference in part to tethers and flexible bands in conjunction with other materials and or mechanisms for swivelling of a drumstick without losing control U.S. Pat No. 3,365,108 to Giba employs a dual-ring type structure with a swivel between rings which provides for 360 degree twirling but does not retain the drumstick at the proper playing angle and requires the use of tools to affix the structure to the drumstick.

None of the prior art provides for a simple elegant one piece device that is comfortable and intuitive to use.

SUMMARY OF THE INVENTION

To overcome the problems the present invention proposes a flexible one piece self gripping attachment which automatically forms a loop when applied to the drumstick.

The drummer inserts a finger into the loop and this provides a flexible anchor holding the drumstick to the hand. Any of the five fingers can be used and different methods of holding the stick can be accommodated.

DESCRIPTION OF THE PREFERRED EMBODIMENTS

Figure 1:
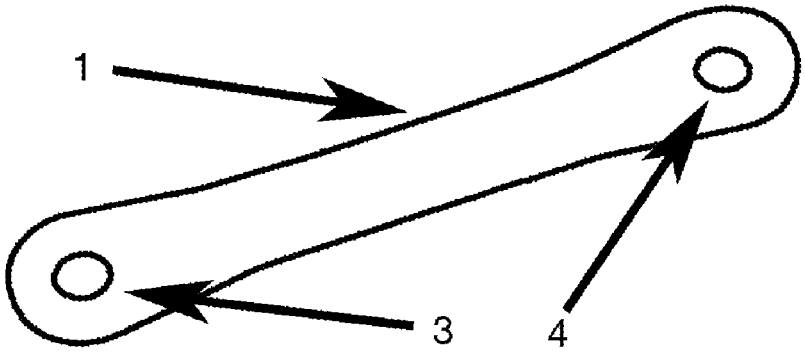
FIG. 1 is a perspective view of the device before it is applied to the drumstick.

In FIG. 1 the device 1, is shown before it is applied to the drumstick

Figure 2:
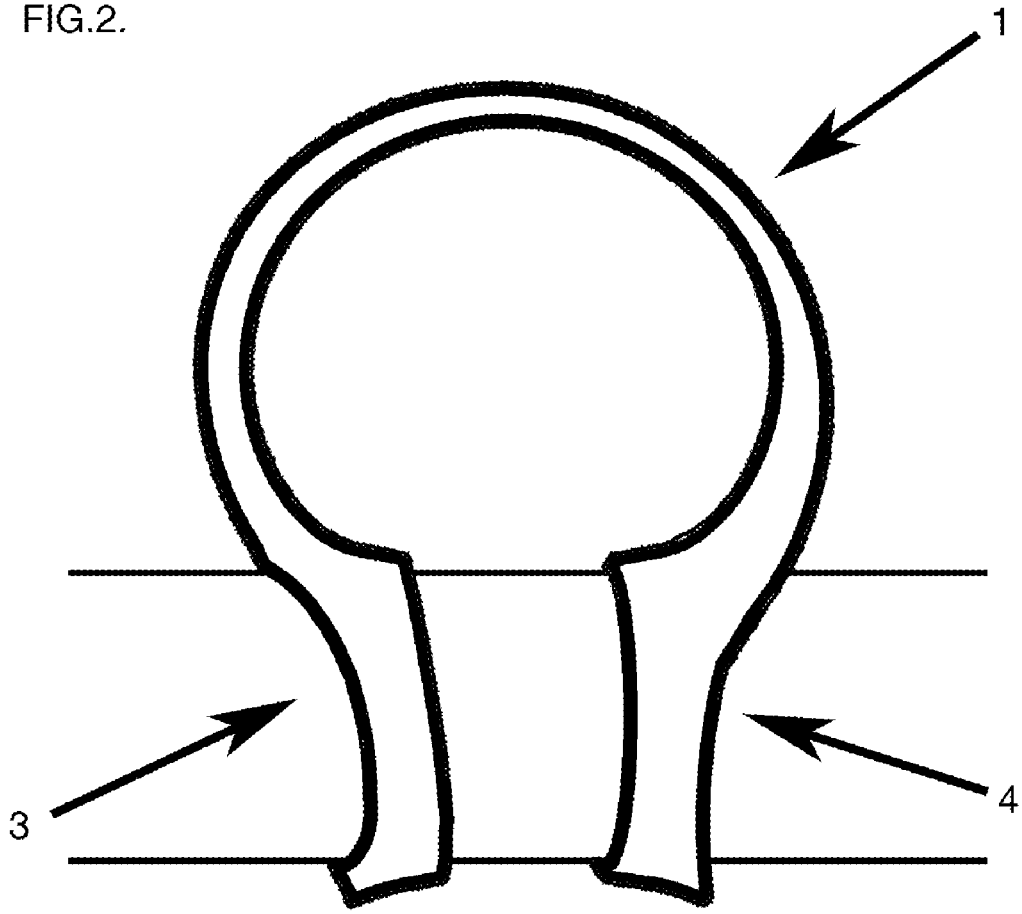
FIG. 2 is a perspective view of the device as applied to the drumstick.

In FIG. 2, the device 1, is shown as applied to the drumstick with circular apertures 3 and 4 gripping the drumstick by compression grip. The loop can be positioned anywhere along the length of the drumstick, to satisfy the drummers preferred balance point. The device is flexible and provides sufficient friction to hold it to any thickness of conventional drumstick and also implements for striking drums which are not round such as bundle sticks.

Figure 3:
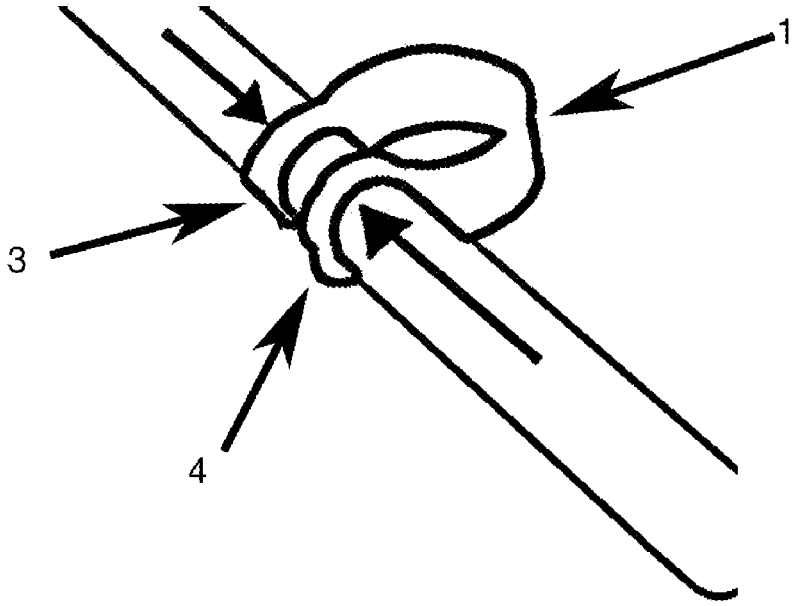
FIG. 3 is a perspective view illustrating the adjustability of the device once applied to the drumstick.

In FIG. 3, the adjustability of the device 1, once applied to the drumstick is illustrated. The circular apertures 3 and 4 can be moved closer towards each other from each other to change the shape and size the loop to accommodate different finger sizes on the left or right hands.

Figure 4:
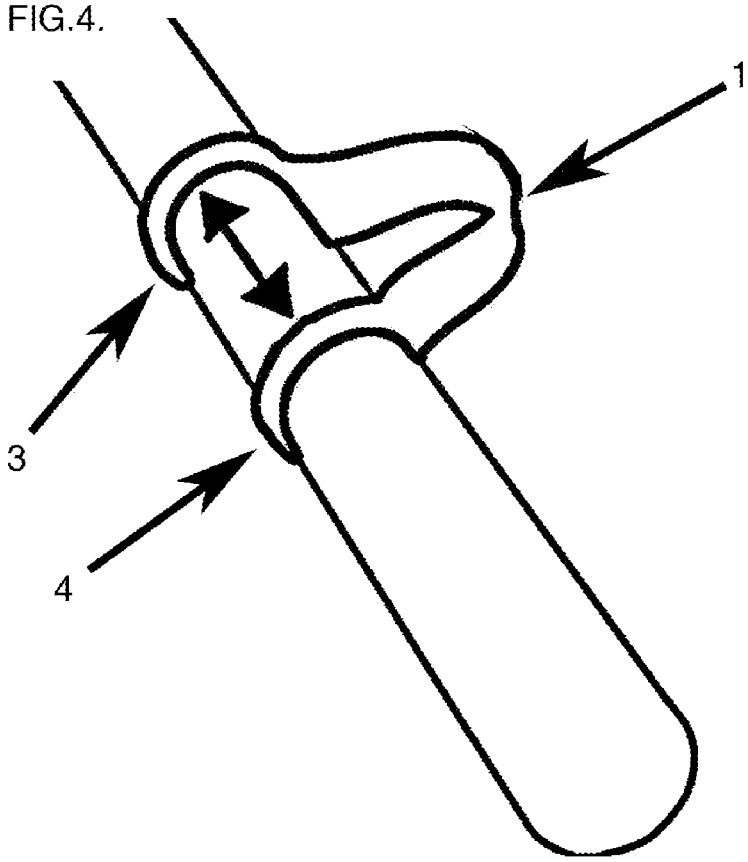
FIG. 4 is a perspective view which further illustrates the adjustability of the device once applied to the drumstick.

In FIG. 4, the adjustability of the device 1, once applied to the drumstick is illustrated. The circular apertures 3 and 4 can be moved further apart from each other to change the shape and size the loop to accommodate different finger sizes on the left or right hands.

Further the loop can be pushed inwards from it edges to provide a small distorted loop which gives tighter grip.

Figure 5:
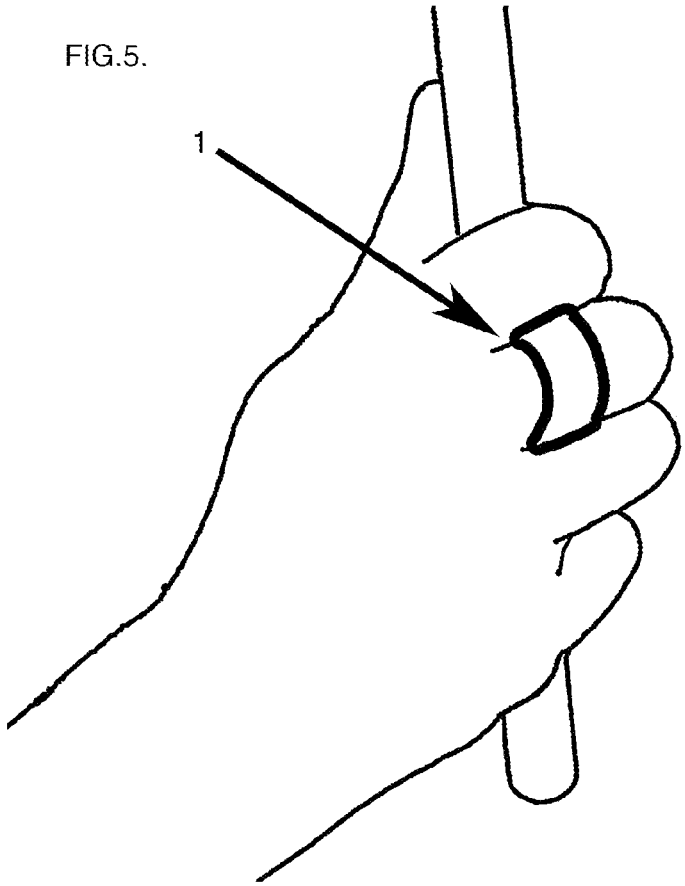
FIG. 5 is a perspective view of the device applied to the drumstick with closed hand holding the drumstick.
Figure 6:
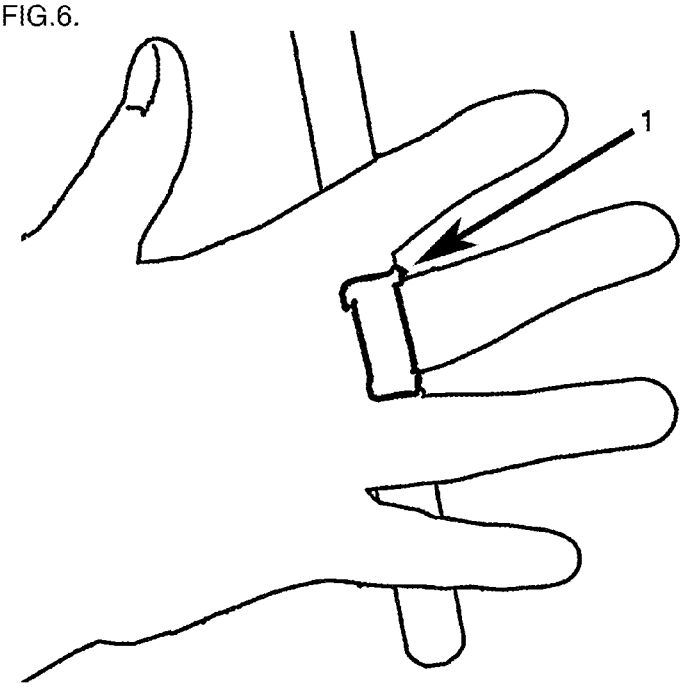
FIG. 6 is a perspective view of the device applied to the drumstick with hand held open.

In FIG. 5, the device 1, is shown applied to the drumstick with a middle finger inserted through the loop. Any finger or thumb can be used In FIG. 6, the device 1, is shown applied to the drumstick with hand held open. The drumstick can be used to strike a percussion instrument in this manner. The flexibility of the loop enables the drummer to play a drum open-handed with only the loop holding onto the stick. The momentum of the drummer's arm and hand is translated into a motion in the stick which flexes the loop and delivers a hit to the drumhead.

The loop enables the drummer to hold the drumsticks lightly and reduce the impact stress of the drumstick as it travels up the arm.

The loop enables the drummer to let go of the drumstick just before impact with a whipping action and allow the stick to hit the drumhead with a greater momentum than is possible by holding onto the stick through to impact. In this way a louder sound can be obtained with less effort.

The loop is a non-permanent fixture and can be removed and refitted to other drumsticks.

The loop is flexible and due to the apertures which retain the drumstick at two or more points, the drumstick can be comfortably orientated at various angles.

The loop material is of a compound that provides friction and a compression grip onto the stick yet is smooth on the finger.

Unlike other devices that grip the finger or require to be gripped, the device hangs from the finger and grips the stick.

One of the aims of the invention was simplicity in design to reduce the cost for manufacture. To help achieve this the invention uses only one piece of material, requires no modification to the drumstick or attachment of any secondary apparatus. Consequently the invention is inexpensive and with no additional materials or secondary manufacturing operations costs are saved on manufacturing and packaging.

Because ease of use was a consideration in the development of the invention, it can be easily attached to the drumstick and the drummer need only use one hand to pick up and play.

A further benefit of the invention is that the drummer can relax the grip on the stick and play in a manner reducing stress and fatigue.

More than one tethering band can be attached to a single drumstick to obtain an even more secure grip.

The flexibility of the tethering band provides comfort due to the breadth on the band distributing pressure on the finger

What is claimed is:

1. A one-piece U-shaped flexible tethering-band with a hole at each end enabling a drumstick to be removably attached without damage to the integrity of the drumstick such that it creates a loop into which one or more of the player's fingers can be inserted preventing loss of grip on the stick; wherein said one-piece U-shaped flexible tethering-band includes three or more holes to receive a drumstick.

2. A one-piece U-shaped flexible tethering-band with a hole at each end enabling a drumstick to be removably attached without damage to the integrity of the drumstick such that it creates a loop into which one or more of the player's fingers can be inserted preventing loss of grip on the stick; wherein said one-piece U-shaped flexible tethering-band includes holes that can distend to accept different diameters of drumstick.

3. A one-piece U-shaped flexible tethering-band with a hole at each end enabling a drumstick to be removably attached without damage to the integrity of the drumstick such that it creates a loop into which one or more of the player's fingers can be inserted preventing loss of grip on the stick; wherein the band can be distorted by moving either or both ends along the length of the drumstick to accommodate different sizes of finger or fingers.

4. A device for use with a drumstick, comprising:

a band comprising a strip of flexible material, with said band including first and second end regions;

a first drumstick-receiving aperture proximate said first end region, and a second drumstick-receiving aperture proximate said second end region; wherein said first and second apertures are movable towards and away from one another;

a loop-forming region between said first and second apertures having at least one dimension that is dependent at least in part upon a distance separating said first and second apertures;

whereby, upon inserting a drumstick through said first and second drumstick-receiving apertures, said loop-forming region defines a finger-receiving loop.

5. The device of claim 4, wherein said device is attached to a drumstick with one end of said drumstick received within said first drumstick-receiving aperture and a second end of said drumstick received within said second drumstick-receiving aperture, whereby said loop-forming region is configured into a finger-receiving loop.

6. The device of claim 5, wherein said device is slidable along the drumstick, whereby said finger-receiving loop can be located at a desired position.

7. The device of claim 5, wherein said first and second apertures retain the drumstick by friction and compression grip.

8. The device of claim 5, wherein each aperture defines a shouldered loop configured to grip the drumstick.

9. The device of claim 5, wherein said device comprises no more than a single piece of said material.

10. The device of claim 5, wherein each aperture is defined by a respective portion of said material that is stretchable; whereby, when a finger is received by the finger-receiving loop, the material proximate each aperture is stretched, thereby causing the shape of each aperture to change according to a profile of the drumstick.

11. The device of claim 4, wherein each aperture is substantially circular.

12. The device of claim 4, wherein each aperture is defined by a respective portion of said material that is stretchable.

13. The device of claim 4, wherein said device comprises no more than a single piece of said material.

14. The device of claim 4, wherein said device is removably mountable on the drumstick.

15. The device of claim 4, wherein, upon inserting a drumstick through said first and second drumstick-receiving apertures, each of said apertures forms a shouldered loop for gripping the drumstick.

16. The device of claim 4, further comprising at least a third drumstick-receiving aperture defined by said flexible material.

17. The device of claim 4 wherein said device, when mounted upon the drumstick, defines a one-piece, substantially U-shaped, flexible tethering band.

18. The device of claim 4 wherein said finger-receiving loop is non-circular.

19. The device of claim 4 wherein said finger-receiving loop is substantially U-shaped.

* * * * *